US007083253B2

(12) United States Patent
Kimura et al.

(10) Patent No.: US 7,083,253 B2
(45) Date of Patent: Aug. 1, 2006

(54) INK JET RECORDING APPARATUS HAVING CLEANING MEANS FOR THE CLEANING OF THE NOZZLE SURFACE OF AN INK JET HEAD

(75) Inventors: Kazuhisa Kimura, Hiratsuka (JP); Hideyuki Akaba, Kawasaki (JP); Hidekazu Ishii, Shizuoka (JP); Hideaki Nishida, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/396,307

(22) Filed: Mar. 25, 2003

(65) Prior Publication Data

US 2004/0189742 A1 Sep. 30, 2004

(51) Int. Cl.
*B41J 2/165* (2006.01)

(52) U.S. Cl. ..... 347/29; 347/23; 347/30; 347/33

(58) Field of Classification Search ..... 347/22–35
See application file for complete search history.

(56) References Cited

U.S. PATENT DOCUMENTS

| | | | | | |
|---|---|---|---|---|---|
| 4,380,770 | A | * | 4/1983 | Maruyama | 347/29 |
| 5,231,424 | A | * | 7/1993 | Kaneko et al. | 347/29 |
| 5,706,038 | A | * | 1/1998 | Jackson et al. | 347/33 |
| 6,283,573 | B1 | | 9/2001 | Nakamura | 347/23 |
| 6,386,677 | B1 | | 5/2002 | Imai et al. | 347/23 |
| 6,746,097 | B1 | | 6/2004 | Im et al. | 247/23 |

FOREIGN PATENT DOCUMENTS

| | | | |
|---|---|---|---|
| JP | 02-095862 A | | 4/1990 |
| JP | 02-179757 A | | 7/1990 |
| JP | 03-099857 | * | 4/1991 |
| JP | 404070355 A | * | 3/1992 |
| JP | 05-201014 A | | 8/1993 |
| JP | 05-220970 A | | 8/1993 |
| JP | 06-135004 A | | 5/1994 |
| JP | 2001-260368 A | | 9/2001 |

OTHER PUBLICATIONS

Related U.S. patent application Ser. No. 10/396,301, filed Mar. 25, 2003; Inventors: Kazuhisa Kimura et al; Title: An Ink Jet Recording Apparatus Having Maintenance Means for the Cleaning an Ink Jet Recording Head, Pending.

Related U.S. patent application Ser. No. 10/403,091, filed Apr. 1, 2003, Inventor: Kazuhisa Kimura; Title: Image Recording Apparatus and Maintenance Method of Recording Head of the Same, Pending.

Merriam–Webster's Collegiate Dictionary, 10$^{th}$ edition, p. 811.*

* cited by examiner

*Primary Examiner*—Shih-Wen Hsieh
(74) *Attorney, Agent, or Firm*—Frishauf, Holtz, Goodman & Chick, P.C.

(57) ABSTRACT

In such a manner that ink in each of a plurality of pressure chambers for holding the ink therein is brought to a positive pressure state of being ejected from respective nozzles respectively communicating with the respective chambers to the outside of each of the pressure chambers, a cleaning member abutted against a nozzle plate formed with a plurality of nozzles is moved along the nozzles in a state in which pressure is applied to all of the pressure chambers, to thereby extrude foreign particles outside the pressure chambers by the ink ejected from the respective nozzles to the outside of the pressure chambers, thereby making it possible to recover the ink, whereby the occurrence of a delivery failure due to the foreign particles around the nozzles being absorbed into the pressure chambers, can be prevented, and the foreign particles contained in the ink can be purged without consuming much ink needlessly.

15 Claims, 14 Drawing Sheets

INK JET RECORDING APPARATUS HAVING CLEANING MEANS FOR THE CLEANING OF THE NOZZLE SURFACE OF AN INK JET HEAD

BACKGROUND OF THE INVENTION

1. Field of the Invention

The present invention relates to an ink jet head cleaning means for the cleaning of the nozzle surface of an ink jet head, and particularly to an ink jet head cleaning means for the cleaning of the nozzle surface of an ink jet head which removes foreign particles lying around ink jet print head nozzles provided in a nozzle plate, for delivering ink droplets through the nozzles, and an ink jet recording apparatus having the same.

2. Description of the Background Art

There has heretofore been known an ink jet recording apparatus which selectively delivers ink droplets to a recording medium through a plurality of nozzles arranged in a nozzle plate to thereby perform printing.

In the ink jet recording apparatus, ink is apt to remain around the nozzles. When such remaining ink is dried/cured in the neighborhood of the nozzles or foreign particles contained in the air are mixed therein, this could lead to turning of the direction of ink delivery, clogging of the nozzles, etc. upon subsequent printing. Thus it becomes apt to produce a failure in ink delivery and a failure in print.

Such failures in ink delivery and print are apt to occur even when foreign particles contained in the ink stay around the nozzles.

Therefore, there have heretofore been proposed various ink jet recording apparatuses which remove ink remaining around nozzles.

There is known, for example, a technology wherein ink is delivered and foreign particles remaining around nozzles are extruded outside an ink jet head, and thereafter the ink lying around the nozzles is recovered by means of suction or the like to thereby remove the foreign particles around the nozzles.

The is also known, for example, a technology wherein a wipe member formed of an elastic body or the like is pressed against a nozzle plate and slid along the nozzle plate in this condition to thereby sweep foreign particles adhered to the nozzle plate.

However, in order to remove the foreign particles staying around the nozzles by using the technology wherein the foreign particles remaining around the nozzles are extruded outside the ink jet head and thereafter the ink remaining around the nozzles is recovered or collected by suction or the like, a large amount of ink must be used with a view toward extruding the foreign particles outside the ink jet head, so that the ink discarded without being used in printing remain in large quantities.

In order to remove foreign particles each having such a size as to cover each nozzle by using such a technology, large pressure must be applied to such nozzles. Thus a burden on the ink jet head increases starting with the periphery of each nozzle and power consumption is also much taken.

Further, when a main ink droplet (ink shot to a medium or the like) is separated from ink upon delivery of the ink, a vapor-liquid interface (ink face or level) is brought or drawn inside each nozzle. There may be a case in which when the vapor-liquid interface is drawn thereinside, foreign particles lying in the neighborhood of the nozzles or floating in the air are drawn inside the nozzles.

In the technology wherein the wipe member formed of the elastic body or the like is pressed against the nozzle plate and slid along the nozzle plate in this condition to thereby sweep the foreign particles adhered to the nozzle plate, the friction occurs between the elastic body and the nozzle plate due to the pressing of the elastic body against the nozzle plate and hence the nozzle plate might be damaged due to the friction. Although a water-repellent ink layer for repelling ink is generally provided on the surface of a nozzle plate against which an elastic body is abutted, the performance of delivery of the ink is degraded when the water-repellent ink layer is damaged due to the friction produced between the elastic body and the nozzle plate, thus leading to a failure in print.

SUMMARY OF THE INVENTION

Accordingly, an object of the present invention is to purge foreign particles contained in ink and foreign particles lying around nozzles without consuming much ink needlessly and damaging a nozzle plate.

Another object of the present invention is to prevent the occurrence of a failure in delivery due to foreign particles around nozzles without providing a particular mechanism and involving an increase in the size of an apparatus, and purge foreign particles contained in ink without consuming much ink needlessly.

A further object of the present invention is to recover foreign particles around nozzles with efficiency.

Yet another object of the present invention is to suppress damage of a nozzle plate upon removal of foreign particles around nozzles.

Those objects of the present invention are achieved by a novel ink jet head cleaning means for the cleaning of the nozzle surface of an ink jet head of the present invention and a novel ink jet recording apparatus.

Thus, according to the novel ink jet head cleaning means for the cleaning of the nozzle surface of an ink jet head of the present invention, a cleaning member abutted against a nozzle plate is moved along nozzles respectively communicating with a plurality of pressure chambers for holding ink therein in a state in which pressure is applied to all the pressure chambers, in such a manner that the ink in each of the plurality of pressure chambers is brought to a positive pressure state of being ejected from the respective nozzles to the outside of each of the pressure chambers.

According to the novel ink jet recording apparatus of the present invention, a cleaning member abutted against a nozzle plate is moved along nozzles respectively communicating with a plurality of pressure chambers included in an ink jet head in a state in which pressure is applied to all of the pressure chambers, in such a manner that ink held in each of the pressure chambers is brought to a positive pressure state of being ejected from the respective nozzles to the outside of each pressure chamber.

BRIEF DESCRIPTION OF THE DRAWINGS

More complete understanding of the present invention and many advantages accompanying the present invention is easily obtained with better understanding by reference to the following detailed description when taken into consideration in connection with the accompanying drawings in which.

DETAILED DESCRIPTION OF THE PREFERRED EMBODIMENTS

Embodiments of the present invention will be described with reference to the accompanying drawings. The present embodiments show examples applied to ink jet recording apparatuses each equipped with an ink jet head cleaning means.

Figure 1:
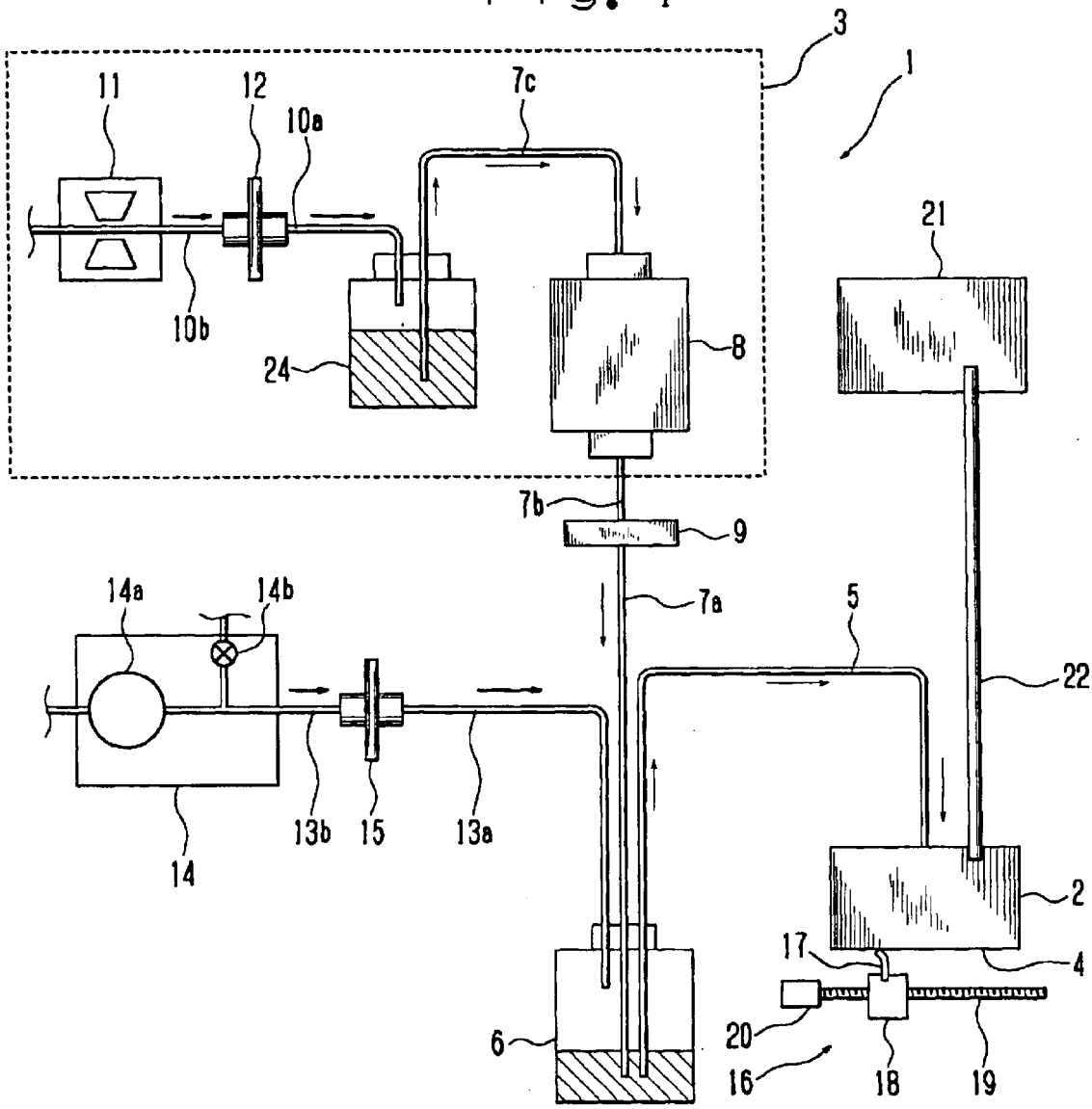
FIG. 1 is a schematic diagram showing an overall configuration of an ink jet recording apparatus showing an embodiment of the present invention.

FIG. 1 is a schematic diagram showing an overall configuration of an ink jet recording apparatus equipped with an ink jet head cleaning means of the present invention. The ink jet recording apparatus 1 of the present invention is provided with an ink jet head 2 for delivering ink to an unillustrated recording medium. Since the illustration and detailed description of the ink jet head 2 are omitted because of the known technology, the ink jet head 2 includes a plurality of pressure chambers for holding ink supplied from an ink tank 24 to be described later, and a nozzle plate 4 formed with a plurality of nozzles 4*a* (see FIG. 10) which cause the pressure chambers and the outside to communicate with one another respectively. The ink jet head 2 delivers ink droplets according to changes in the volumes of the pressure chambers to thereby perform printing.

In the present embodiment, various liquid-type inks such as aqueous, oil, and ultra-violet cured ones are used. The ink employed in the present embodiment contains pigment or dye or the like as a color material.

The ink jet head 2 is provided reciprocatingly along a vertical direction as viewed on the sheet in FIG. 1 by means of an unillustrated head support mechanism. The head support mechanism is driven by a head elevation motor 2*a* (see FIG. 4) upon execution of a nozzle cleaning operation to reciprocate the ink jet head 2 along the vertical direction as viewed on the sheet in FIG. 1.

A pressure control tank 6 is made to communicate with an ink support port of the ink jet head 2 through a pipe line member 5. The ink supplied from the ink tank 24 is temporarily held in the pressure control tank 6. An end of the pipe line member 5 on the pressure control tank 6 side is located in the ink to such an extent that it is not brought into contact with a bottom face of the pressure control tank 6. Although not illustrated in FIG. 1, the pressure control tank 6 is provided with a waterhead difference sensor 31 (see FIG. 4) whose output changes according to the position of a vapor-liquid interface of the ink in the pressure control tank 6. Although the illustration and description thereof are omitted because of the known technology, the waterhead difference sensor 31 may make use of known various sensors such as a photosensor, a float-type level sensor, etc.

A pipe line member 7*a* is made to communicate with the pressure control tank 6. One end that belongs to the pressure control tank 6 side, of the pipe line member 7*a* is positioned in the ink to such an extent that it does not come into contact with the bottom face of the pressure control tank 6.

A cutoff valve 9 is made to communicate with the other end of the pipe line member 7*a*. The cutoff valve 9 is selectively positioned to either one of an open position at which the supply of the ink from the ink tank 24 to be described later to the pressure control tank 6 is allowed, and a cutoff position at which the flowage of the ink between the ink tank 24 and the pressure control tank 6 is shut off.

A filter 8 is made to communicate with the cutoff valve 9 through a pipe line member 7*b*. The filter 8 removes foreign particles contained in the ink that flows into the pressure control tank 6 via the pipe line members 7*a* and 7*b*. Consequently, the ink from which the foreign particles have been removed, is supplied to the pressure control tank 6.

The ink tank 24 is made to communicate with the filter 8 via a pipe line member 7*c*. Even in the case of the pipe line member 7*c*, one end thereof, which belongs to the ink tank 24 side, is positioned in the ink to such an extent that it does not come into contact with the bottom face of the ink tank 24.

The ink tank 24 takes such a configuration as to be capable of holding the ink supplied to the ink jet head 2 and newly performing refilling of the ink when the remaining amount of ink held therein decreases.

Figure 2A:
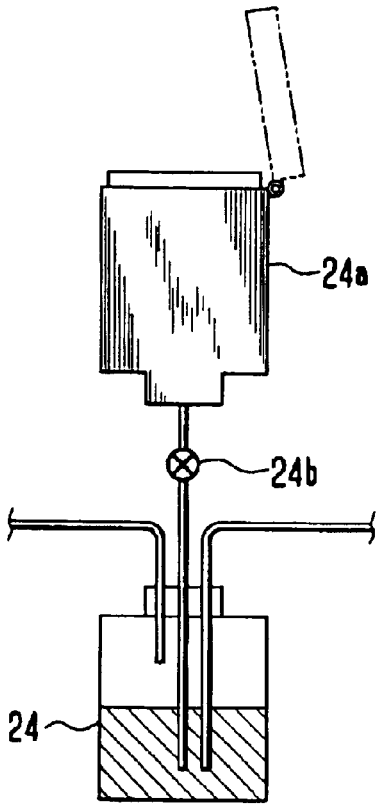
FIG. 2A is an explanatory view illustrating an ink refill mechanism for an ink tank of the ink jet recording apparatus showing the embodiment of the present invention.

A valve 24*b* for allowing an ink refill container 24*a* for enabling refilling of ink from outside to communicate with an ink tank 24 and selectively communicating the ink tank 24 and the ink refill container 24*a* with each other by opening/closing is provided as shown in FIG. 2A, for example, to thereby make it possible to realize such a configuration as to enable refilling of the ink into the ink tank 24. According to such a configuration as shown in FIG. 2A, when the remaining amount of ink held in the ink tank 24 decreases, refilling of the ink into the ink refill container 24*a* is performed in a closed state of the valve 24*b*, and the valve 24*b* is suitably made open according to the remaining amount of ink held in the ink tank 24, thereby making it possible to refill the ink tank 24 with the ink.

Figure 2B:
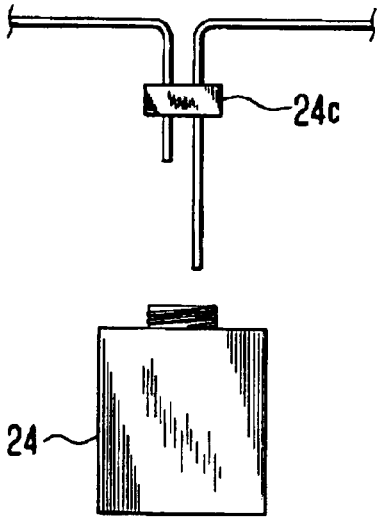
FIG. 2B is an explanatory view illustrating another ink refill mechanism for the ink tank of the ink jet recording apparatus showing the embodiment of the present invention.

As shown in FIG. 2B, for example, an ink tank 24 is attached to a cap member 24*c* of the ink tank 24 by a screw structure, whereby such a configuration as to enable refilling of ink into the ink tank 24 can be realized. According to such a configuration as shown in FIG. 2B, when the remaining amount of ink held in the ink tank 24 is reduced, refilling of the ink can be newly performed by replacing the ink tank 24 with another.

A filter 12 is in communication with the ink tank 24 via a pipe line member 10*a*. The filter 12 removes foreign particles contained in the air that flows into the ink tank 24 via the pipe line member 10*a*. Thus, only the air from which the foreign particles have been removed, is supplied to the ink tank 24. Incidentally, an end, which belongs to the ink tank 24 side, of the pipe line member 10*a*, is located in a position where it is not brought into contact with a vapor-liquid interface (ink level or face) between the ink and air in the ink tank 24.

An air feed pump 11 is connected to the filter 12 through a pipe line member 10*b*. The air feed pump 11 feeds air to the ink tank 24 through the pipe line members 10*a* and 10*b* and filter 12 to raise the pressure in the ink tank 24.

The filter 12 is provided on the upstream side of the pipe line member 10. The filter 12 removes foreign particles contained in the air fed to the ink tank 24 by the air feed pump 11.

In the present embodiment, an ink supply unit 3 is realized by the ink tank 24, pipe line members 7*c*, 10*a* and 10*b*, filter 8, air feed pump 11, etc.

A filter 15 is made to communicate with the pressure control tank 6 through a pipe line member 13*a*. The filter 15 removes foreign particles contained in the air that flows into the pressure control tank 6 through a pipe line member 13*a*. Consequently, the pressure control tank 6 is supplied with only the air from which the foreign particles have been removed. Incidentally, an end, which belongs to the ink tank 24 side, of the pipe line member 10*a*, is located in a position where it does not come into contact with a vapor-liquid interface (ink level) between the ink and air in the ink tank 24.

A purge device 14 is coupled to the filter 15 through a pipe line member 13*b*. The purge device 14 includes a purge pump 14*a* (see FIG. 1) for feeding air into the pressure control tank 6 to thereby pressurize the interior of the pressure control tank 6. In the present embodiment, a pressure pump is realized by the purge pump 14*a* with which the purge device is equipped. Actuating the purge pump 14*a* makes it possible to pressurize the interior of the pressure control tank 6 and open its interior into the air. A valve 14*b* is provided on the side closer to the filter 15 than the purge pump 14*a* as viewed in the pipe line member 13*b*. This valve is selectively positioned to any one of an open position at which the interior of the pressure control tank 6 is opened into the air through the pipe line member 13*b*, and a block position at which the valve keeps a closed state between the purge pump 14*a* and the pressure control tank 6.

Incidentally, the distance from the purge device 14 to the pressure control tank 6 is set shorter than that from the ink tank 24 to the pressure control tank 6.

The ink jet recording apparatus 1 is provided with an unillustrated conveying mechanism for conveying a medium to be recorded such as printing paper or the like in such a way as to pass through the position of delivery of ink droplets by the ink jet head 2. This conveying mechanism conveys the medium along a sub-scanning direction by being supplied with a driving force by a conveying motor 25 (see FIG. 4). Incidentally, the description of the conveying mechanism and conveying motor are omitted because of the known techniques.

In addition, the ink jet recording apparatus 1 is equipped with an ink jet head cleaning means 16. The ink jet head cleaning means 16 has a cleaning member 17 formed of an elastic material. The cleaning member 17 can be formed of, for example, foam urethane having foam and flexibility.

The cleaning member 17 is supported by a support member 18 so as to abut against the nozzle plate 4. The support member 18 supports the cleaning member 17 to such an extent that the tip of the cleaning member 17 comes in contact with the nozzle plate 4. The support member 18 is movable along the direction of an arrangement of nozzles 10 by a screw member 19 and a cleaning motor 20. Here, a mechanism for moving the cleaning member 17 along the nozzles 10 is realized.

The ink jet head cleaning means 16 is provided on a stage 30. The stage 30 is provided with a cap 29 detachably fitted to the ink jet head 2. The cap 29 is fitted to the ink jet head 2 upon execution of a purge operation and non-execution of a print operation. Fitting the cap 29 onto the ink jet head 2 upon execution of the purge operation makes it possible to prevent ink from flying around. Fitting the cap 29 onto the ink jet head 2 upon non-execution of the print operation enables prevention of a degeneration change in ink such as drying, curing or the like, and adhesion of foreign particles to the peripheries of the nozzles 10.

Figure 3A:
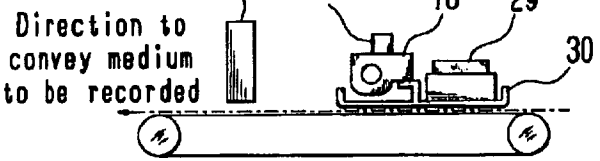
FIG. 3 is an explanatory view for describing a print position, a cleaning position and a standby position.
Figure 3B:
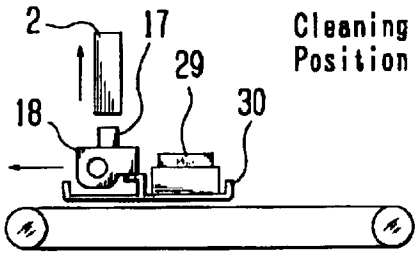
Figure 3C:
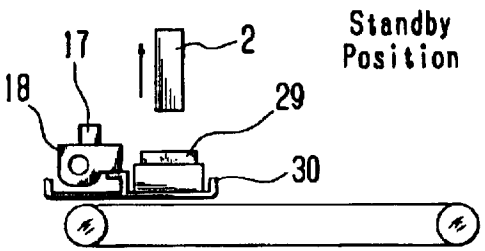

The stage 30 is movable along the conveying direction of the medium to be recorded. Subsequently, the position of the stage 30 where the cleaning member 17 is not abutted against the nozzle plate 4 and the cap 29 is not fitted to the ink jet head 2 either, is taken as a print position as shown in FIG. 3A. Similarly, the position of the stage 30 where the cleaning member 17 is allowed to abut against the nozzle plate 4, is taken as a cleaning position as shown in FIG. 3B. Further, the position of the stage 30 where the cap 29 is allowed to fit to the ink jet head 2, is taken as a standby position as shown in FIG. 3C. The stage 30 is selectively positioned to either the print position, the cleaning position or the standby position. A stage moving motor 28 (see FIG. 4) is coupled to the stage 30 through an unillustrated drive transmission mechanism. Thus, the stage 30 is driven by the stage moving motor 28 and moved along the conveying direction of the medium to be recorded.

Figure 3D:
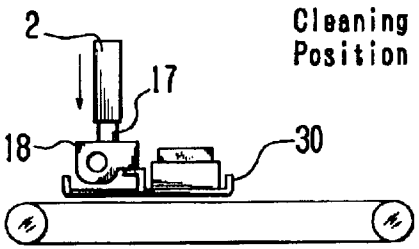
Figure 3E:
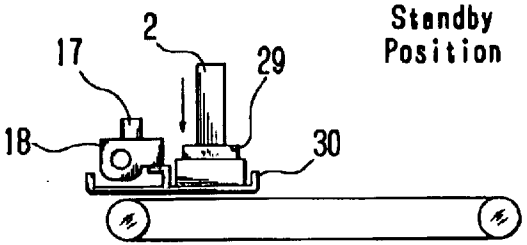

Since the ink jet head 2 is provided reciprocatingly along the vertical direction as viewed on the sheet in FIG. 1 as described above, the ink jet head 2 is suitably moved upwards and downwards upon positioning of the ink jet head cleaning means 16 to the cleaning position or the standby position. Namely, when the stage 30 is positioned to the cleaning position and the cleaning member 17 is abutted against the nozzle plate 4, the stage 30 as positioned to the cleaning position while the ink jet head 2 is being moved upwards (see FIG. 3B), and the ink jet head 2 is moved downward in a state in which the stage 30 has been positioned to the cleaning position (see FIG. 3D). When the stage 30 is positioned to the standby position and the cap 29 is fitted to the ink jet head 2, the stage 30 is positioned to the cleaning position while the ink jet head 2 is being moved upwards (see FIG. 3C), and the ink jet head 2 is moved downwards in a state in which the stage 30 has been positioned to the cleaning position (see FIG. 3E).

The ink jet recording apparatus 1 includes various control keys 26 which accept various operations made by an operator such as instructions for execution of a cleaning operation to be described later, etc.

Figure 4:
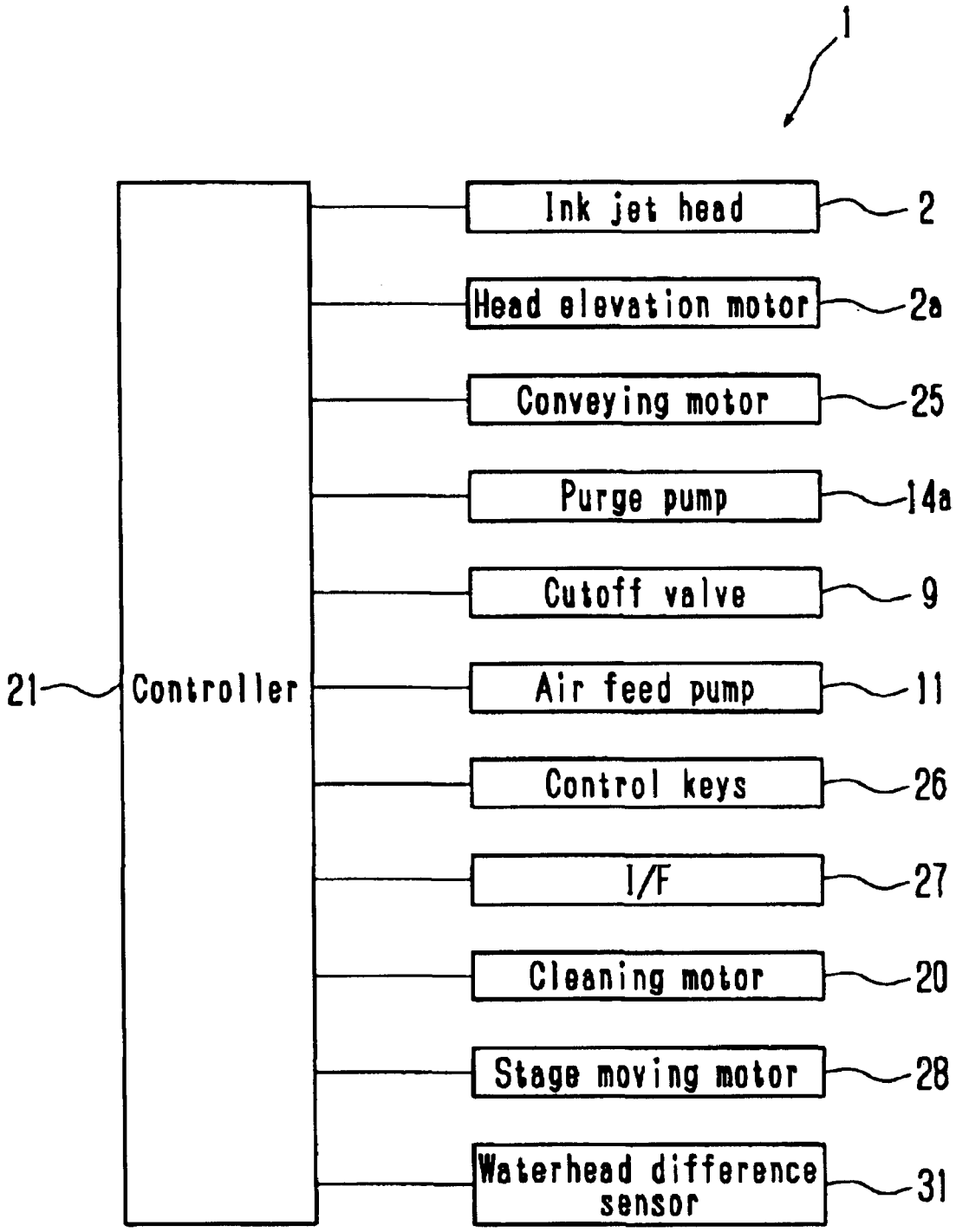
FIG. 4 is a block diagram schematically showing electrical connections of respective portions with which the ink jet recording apparatus showing the embodiment of the present invention is equipped.

Here, FIG. 4 is a block diagram schematically showing electrical connections of respective portions with which the ink jet recording apparatus 1 showing the embodiment of the present invention is equipped. The ink jet recording apparatus 1 is provided with a controller 21 for driving and controlling the respective portions with which the ink jet recording apparatus 1 is equipped, starting with the ink jet head 2. Although not shown in the drawing in particular, the controller 21 is made principally of a microcomputer configured by connecting a CPU for driving and controlling the respective portions included in the ink jet recording apparatus 1, and various memories such as a ROM, a RAM, etc. The ink jet head 2, head elevation motor 2*a*, conveying motor 25, purge pump 14*a*, cutoff valve 9, air feed pump 11, control keys 26, cleaning motor 20 and stage moving motor 28 are connected to the controller 21. The ink jet head 2, head elevation motor 2*a*, conveying motor 25, purge pump 14*a*, cutoff valve 9, air feed pump 11, control keys 26, cleaning motor 20 and stage moving motor 28 are driven and controlled by the controller 21.

The controller 21 outputs a drive signal based on print data through a signal line 22 upon execution of a print operation to be described later, for example to thereby drive and control an ink delivery operation at the ink jet head 2 and drive and control the conveying motor 25, head elevation motor 2*a*, cleaning motor 20 and stage moving motor 28, etc.

Further, the controller 21 is provided with an I/F 27 which performs data communications between the controller 21 and an unillustrated externally-connected device connected to the ink jet recording apparatus 1 and receives print data transmitted from the externally-connected device by means of the function of this I/F.

When a power supply of the ink jet recording apparatus 1 is turned on, the ink jet recording apparatus 1 according to the present embodiment drives and controls the respective portions through the use of the controller 21 to thereby carry out an initial operation. Incidentally, the illustration and description of the initial operation are omitted because of the known technology.

Figure 5:
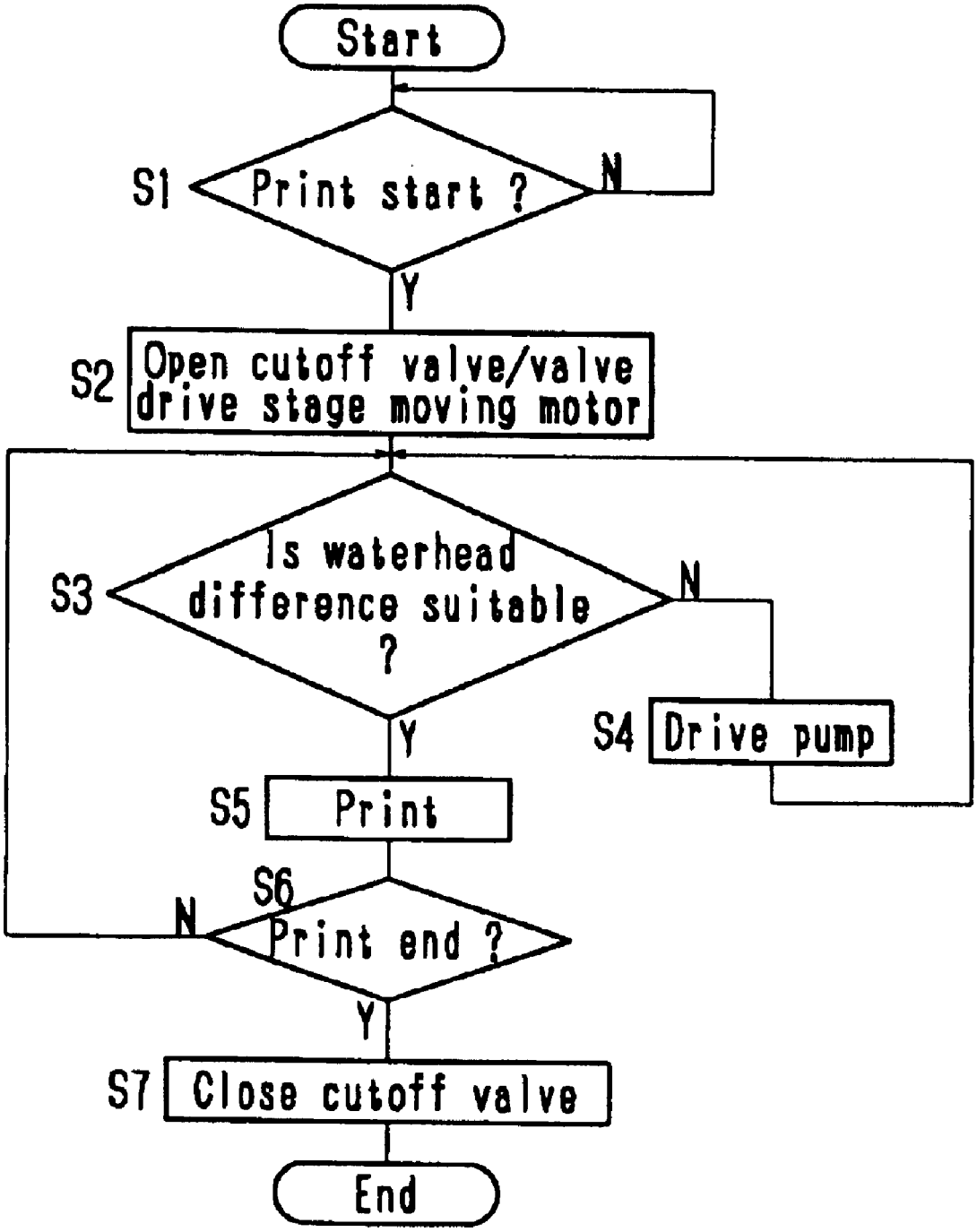
FIG. 5 is a flowchart for schematically describing a print operation executed by a controller with which the ink jet recording apparatus showing the embodiment of the present invention is equipped.

The print operation of the ink jet recording apparatus 1 will next be described. FIG. 5 is a flowchart for schematically describing the print operation executed by the controller 21 with which the ink jet recording apparatus 1 showing the embodiment of the present invention is equipped. The print operation is started when as described above, the initial operation has been finished and the execution of the print operation onto the ink jet recording apparatus 1 placed in a standby state is declared. Here, the execution of the print operation is declared by, for example, operations of the control keys 26 by the operator or reception of print data received via the I/F 27 and transmitted from the externally-connected device.

When it is determined that the execution of the print operation has been declared (Y in Step S1) during standby up to the declaration of execution of the print operation (N in Step S1), each of the cutoff valve 9 and the valve 14*b* is located in an open position, and the stage moving motor 28 is driven to position the stage 30 to its corresponding print position (Step S2).

It is then determined based on an output value of the waterhead difference sensor 31 that the amount of ink in the pressure control tank 6 falls within a suitable range (Step S3).

It is determined based on the output value of the waterhead difference sensor 31 that the amount of ink in the pressure control tank 6 does not fall within the suitable range (N in Step S3), the air feed pump 11 is driven (Step S4). Thus, the interior of the ink tank 24 is pressurized so that refilling of the ink held in the ink tank 24 into the pressure control tank 6 is performed via the pipe line members 7*a*, 7*b* and 7*c* and the filter 8. At this time, foreign particles contained in the ink with which the pressure control tank 6 is refilled are removed by passing through the filter 8.

Next, the conveying motor for applying the driving force to the conveying mechanism is driven and the ink jet head 2 is driven and controlled based on the print data to thereby execute print processing (Step S5).

The description of the print processing executed in Step S5 is omitted because of the known technology. The conveying motor 25 is driven to selectively apply a voltage to an electrode for the ink jet head 2 based on the print data while the medium to be recorded is being conveyed in a conveying path. Thus, a change in the volume of the pressure chamber corresponding to the electrode to which the voltage is applied, occurs. With the volume change, ink droplets are selectively delivered to the medium conveyed in the conveying path so that printing is done. When the print processing is completed, the driving of the conveying motor 5 is stopped.

The completion of the print processing executed in Step S5 is placed in a standby state (N in Step S6). When it is determined that the print processing has been completed (Y in Step S6), the cutoff valve 9 is positioned to the block position (step S7) and the print operation is hence terminated.

Figure 6:
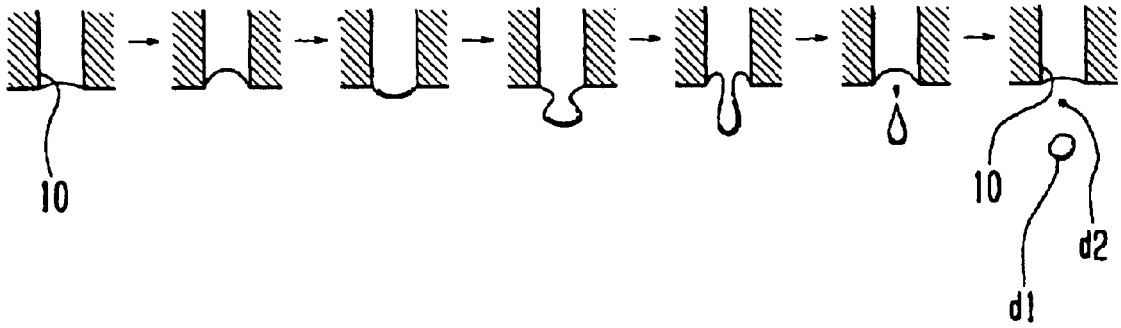
FIG. 6 is an explanatory view showing behaviors of ink around nozzles which deliver ink droplets upon execution of the print operation.
Figure 7:
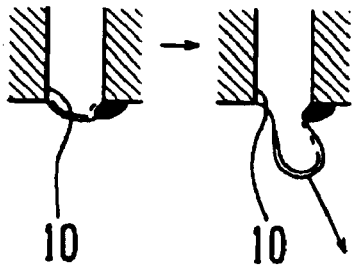
FIG. 7 is an explanatory view illustrating a state of a failure in the delivery of ink.

Here, FIG. 6 shows behaviors of ink around the nozzles 10 which deliver the ink droplets upon execution of the above-described print operation. As described above, the print operation is realized by delivering the ink droplets from the nozzle 10 to be delivered to the medium to be recorded and shooting the ink droplets onto the medium. Upon actual delivery of ink droplets, however, a main ink droplet d1 which is shot onto the medium and contributes to printing, and a small ink droplet d2 separated from the main droplet are often generated as shown in FIG. 6. When the small ink droplet d2 adheres to the periphery of the nozzle 10 and degenerates as it is or absorbs dusts or the like therearound, thereby leading to foreign particles, an obstacle is produced upon the delivery of the ink droplets. Thus, they could lead to the occurrence of a failure in the delivery of ink, like turning of the delivery direction of ink droplets to an unsuitable direction, etc. as shown in FIG. 7. It is therefore necessary to remove them.

There may be cases in which when, for example, the print operation is not performed for a long period, ink adjacent to a vapor-liquid interface (meniscus) at each nozzle 10 increases in viscosity, pigment or the like coagulates, or surrounding dust is mixed, so that the ink adjacent to the vapor-liquid interface (meniscus) is brought to a state unsuitable for its delivery. Since the ink held in such an unsuitable state is not capable of performing satisfactory printing, it is necessary to remove it after all.

The ink jet recording apparatus 1 according to the present embodiment executes a nozzle cleaning operation to be described below to thereby remove the remaining ink and foreign particles around the nozzles 10, and the ink degenerated in the nozzles 10, etc.

Figure 8:
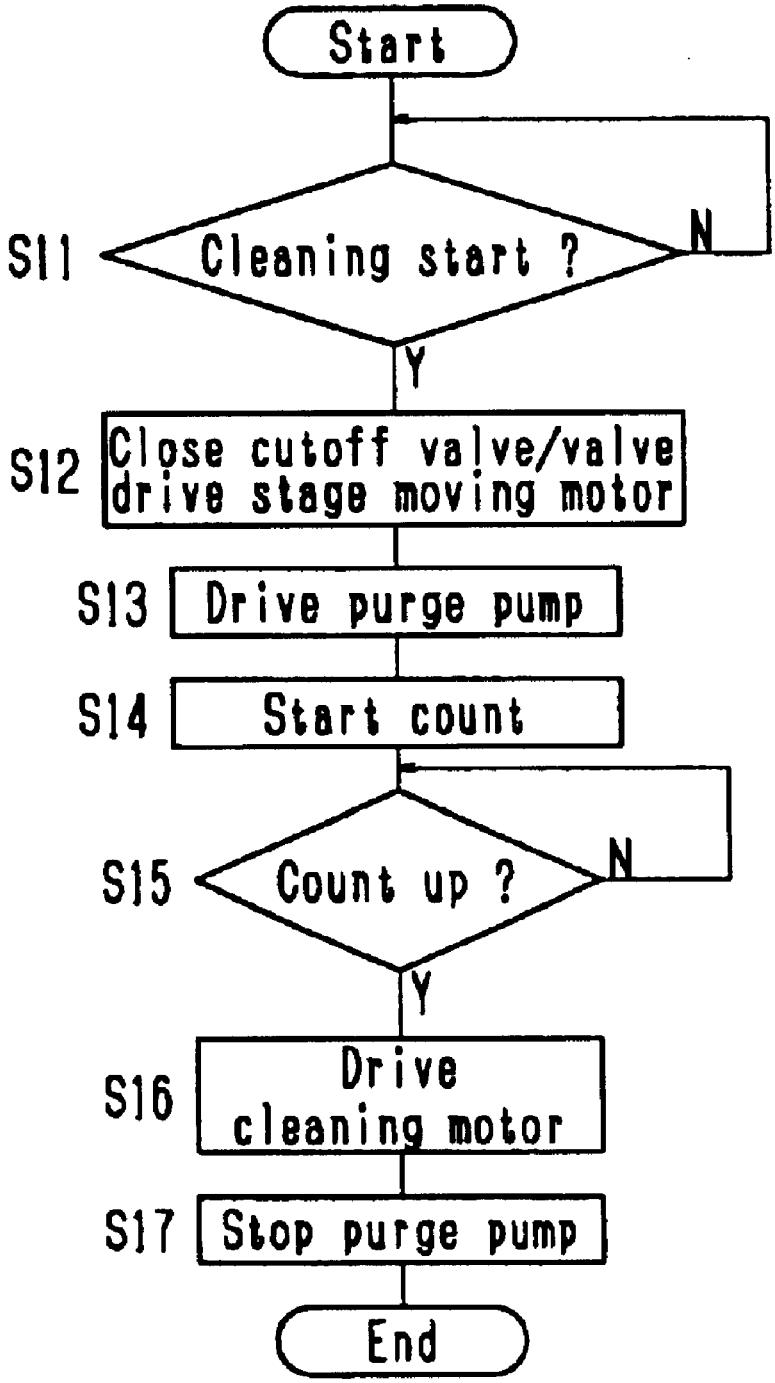
FIG. 8 is a flowchart for schematically describing a nozzle cleaning operation executed by the controller with which the ink jet recording apparatus showing the embodiment of the present invention is equipped.

The nozzle cleaning operation of the ink jet recording apparatus 1 will next be described. FIG. 8 is a flowchart for schematically describing a nozzle cleaning operation executed by a control system. The nozzle cleaning operation is performed with the timing at which the execution of the nozzle cleaning operation is declared by the operations of the control keys 26 by the operator or the timing at which the above-described print operation is executed a predetermined number of times.

When it is determined that the execution of the nozzle cleaning operation has been declared (Y in S11) while the declaration of execution of the nozzle cleaning operation is being awaited (N in Step S11), each of the cutoff valve 9 and the valve 14*b* is positioned to the block position to shut off the supply of ink from the ink tank 24, and the stage moving motor 28 is driven to position the stage 31 to the cleaning position (Step S12).

Then the purge pump 14*a* is driven to apply pressure to the pressure control tank 6 (Step S13) and start to count a time interval that elapsed since the start of driving of the purge pump 14*a* (Step S14).

Figure 9A:
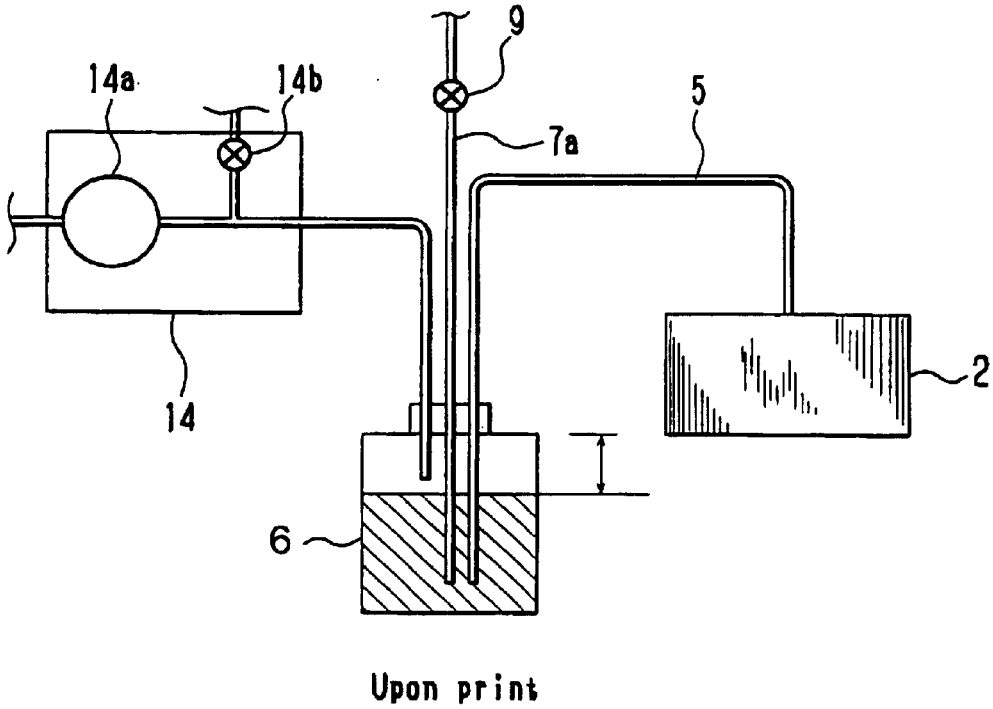
FIG. 9 is an explanatory view showing variations in vapor-liquid interface in a pressure control tank at the execution of the nozzle cleaning operation.
Figure 9B:
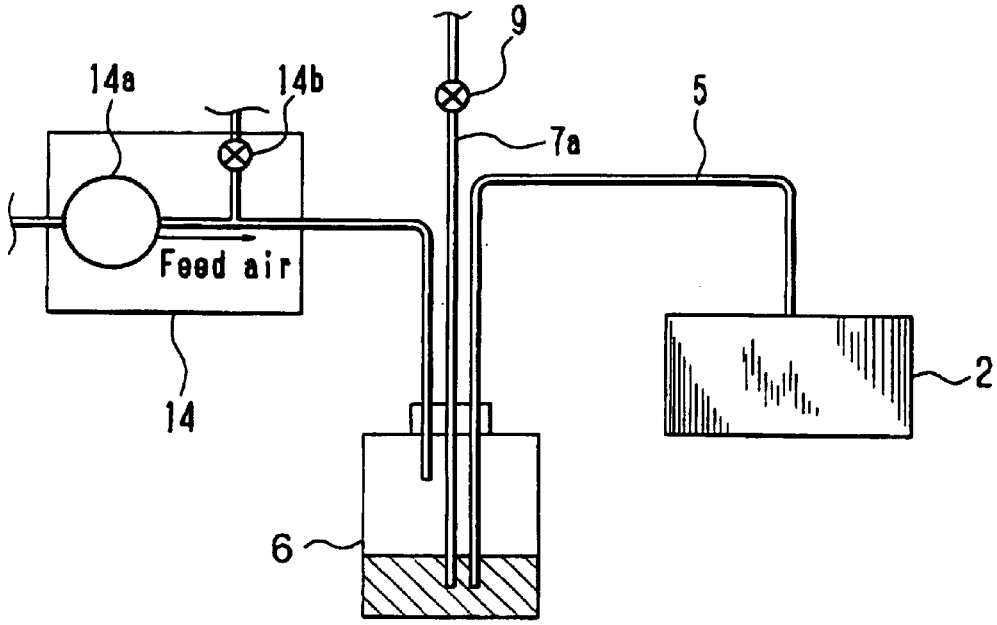

Here, FIG. 9 shows changes in vapor-liquid interface at the pressure control tank 6 upon execution of the nozzle cleaning operation. Since the valve 14*b* is open upon execution of the print operation as shown in FIG. 9A, atmospheric pressure is applied to the vapor-liquid interface at the pressure control tank 6. On the other hand, the purge pump 14*a* is driven in a blocked state of the valve 14*b* so that pressure is applied to the vapor-liquid interface at the pressure control tank 6 to shift the position of the vapor-liquid interface downwards as shown in FIG. 9B. Such pressure for moving the position of the vapor-liquid interface downwards acts so as to extrude the ink held in the pressure control tank 6 toward the ink jet head 2 through the pipe line member 5. A mechanism for applying the pressure is realized here. Thus, pressure is applied to each of the pressure chambers and hence the ink in each pressure chamber is extruded from the nozzles 10 under the pressure (see FIG. 10A).

Namely, the purge pump 14*a* applies such pressure that the ink in each pressure chamber is held in a state of being ejected from the respective nozzles 10 to the outside of the pressure chamber. In the present embodiment, the state in which such pressure as to be ejected from the respective nozzles 10 to the outside of the pressure chamber is applied to the ink in each pressure chamber, is taken as a positive pressure state as shown in FIG. 10. The pressure applied to the ink in the pressure chamber under the positive pressure state is lower than that for delivering the ink upon the print operation and is pressure of such an extent that the ink level at each nozzle 10 is located outwardly from the outer surface of the nozzle plate 4.

Figure 10A:
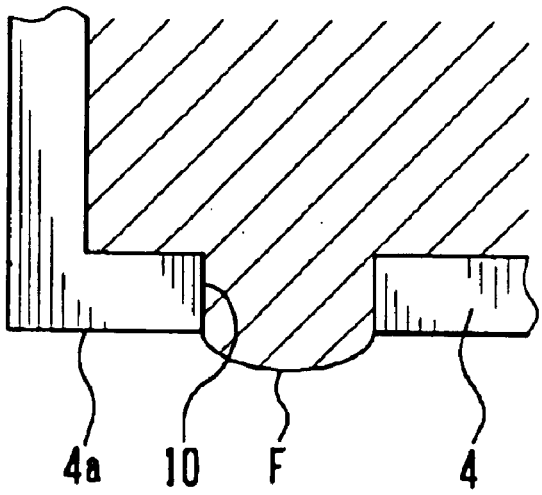
FIG. 10A is an explanatory view showing a state of ink levels at respective nozzles where an ink jet head with which the ink jet recording apparatus showing the embodiment of the present invention is equipped, is under a positive pressure state.

Here, the state in which the ink level at each nozzle 10 is located outward from the outer surface 4*a* of the nozzle plate 4, means such a state as shown in FIG. 10A. As is understood even from FIG. 10A, the inks extruded by the pressure applied to the pressure chambers are respectively brought to a state of being ejected from the respective nozzles to the outside of the pressure chambers by their own surface tensions under the positive pressure state. Namely, an ink level or face F at each nozzle 10 under the positive pressure state is located below the outer surface 4*a* of the nozzle plate 4 in the present embodiment. Pressure expressed in an equation (1) shown below is applied to the ink under the positive pressure state in a vertical direction:

$$PT=H\times(4/D)\cos\theta \quad (1)$$

In the equation (1), H indicates a surface tension of ink, D indicates the diameter of each nozzle 10, and θ indicates a contact angle of the ink at each nozzle 10, respectively.

The controller 21 controls the pressure applied by the purge pump 14*a* so that it is lower than the pressure PT expressed in the equation (1) at a nozzle position X. Here, means for controlling the pressure applied to each pressure chamber is realized. Thus, the state in which the ink has been ejected from the nozzles 10 to the outside of the pressure chamber, can be maintained without dropping the ink from the nozzles 10.

Figure 10B:
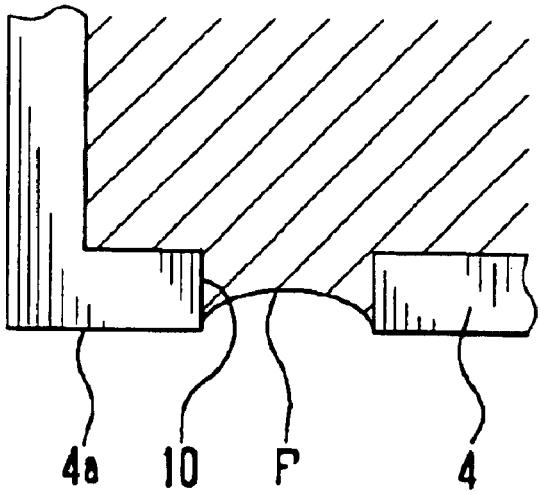
FIG. 10B is an explanatory view showing a state of ink levels at respective nozzles where the ink jet head with which the ink jet recording apparatus showing the embodiment of the present invention is equipped, is under a negative pressure state.

Incidentally, a state in which pressure of such an extent that an ink level F' at each nozzle 10 is recessed toward the pressure chamber side rather than the outer surface 4*a* of the nozzle plate 4, s applied to the ink in the pressure chamber under the positive pressure state, is assumed to be a negative pressure state as shown in FIG. 10B in the present embodiment.

The controller is on standby in the positive pressure state as it is until the count started in Step S14 reaches a preset time (N in S15). When the count started in Step S14 reaches the preset time (Y in S15), the cleaning motor 20 of the ink jet head cleaning means 16 is driven (Step S16) to move the cleaning member 17 along the nozzles 10 in a state of being abutted against the nozzle plate 4.

As the cleaning member 17, for example, foam urethane having flexibility and a number of bubbles is used. Under its use, the cleaning member 17 is moved so as to rub against the nozzle plate 4, thereby making it possible to take the remaining ink and foreign particles into the bubbles. Thus, the ink remaining around the nozzles 10, for example, can be swept away without complicating a structure.

The application of pressure to the interior of the pressure control tank 6 by driving the air feed pump 11 is also considered as to control on the vapor-liquid interface (meniscus) at each nozzle 10, which is performed upon execution of the nozzle cleaning operation. In this case, the air feed pump 11 supplies the ink held in the ink tank 24 to the pressure control tank 6 to thereby pressurize the interior of the pressure control tank 6. In general, a pressure loss in liquid is much larger than a pressure loss in gas.

In the present embodiment, the vapor-liquid interface (meniscus) at each nozzle 10 is controlled using the purge pump 14*a* with which the purge device 14 is equipped, upon execution of the nozzle cleaning operation. Therefore, the interior of the pressure control tank 6 can be pressurized with efficiency as compared with the case where the air feed pump 11 is driven to pressurize the pressure the interior of the pressure control tank 6. Particularly since the distance from the purge device 14 to the pressure control tank 6 is set shorter than that from the ink tank 24 to the pressure control tank 6 in the present embodiment, the interior of the pressure control tank 6 can be pressurized with efficiency.

Now, the controller waits in the positive pressure state as it is until the count started in Step S14 reaches the preset time. In this state, the motor in the purge device 14 is driven to apply pressure, thereby making it possible to stabilize a change in ink level at each nozzle 10 and collect foreign particles contained in ink around each nozzle 10 into the ink ejected from the nozzle 10. In this state, the cleaning member is operated to make it possible to more effectively remove the foreign particles remaining around the nozzles 10, for example.

Thus, the foreign particles remaining on the periphery of each nozzle 10 and the like can be removed to such an extent that the cleaning member 17 is brought into contact with the nozzle plate 4 as in the present embodiment, without powerfully pressing the cleaning member 17 against the nozzle plate 4. It is therefore possible to prevent damage of a water-repellent ink layer provided in the nozzle plate 4 due to the friction between the cleaning member 17 and the nozzle plate 4.

Since the cleaning member 17 is formed of the elastic member such as urethane rubber or the like in particular in the present embodiment, the nozzle plate 4 is hard to flaw even when the cleaning member 17 rubs against the nozzle plate 4.

Further, the cleaning member is formed as the urethane rubber, i.e., by using urethane rubber having such a property that it is softened with its water absorption, so that damage of the nozzle plate 4 can be prevented more reliably.

Incidentally, no limitation is imposed on the method using the above-described purge device 14 as the method of setting the ink jet head 2 to the positive pressure state upon the nozzle cleaning operation. For example, the ink jet head 2 may be set as the positive pressure state according to the relationship of vertical position between the pressure control tank 6 and each nozzle 10. Such an ink jet recording apparatus 1 that the ink jet head 2 is brought to the positive pressure state according to the relationship of vertical position between the pressure control tank 6 and each nozzle 10 will be explained below.

Figure 11:
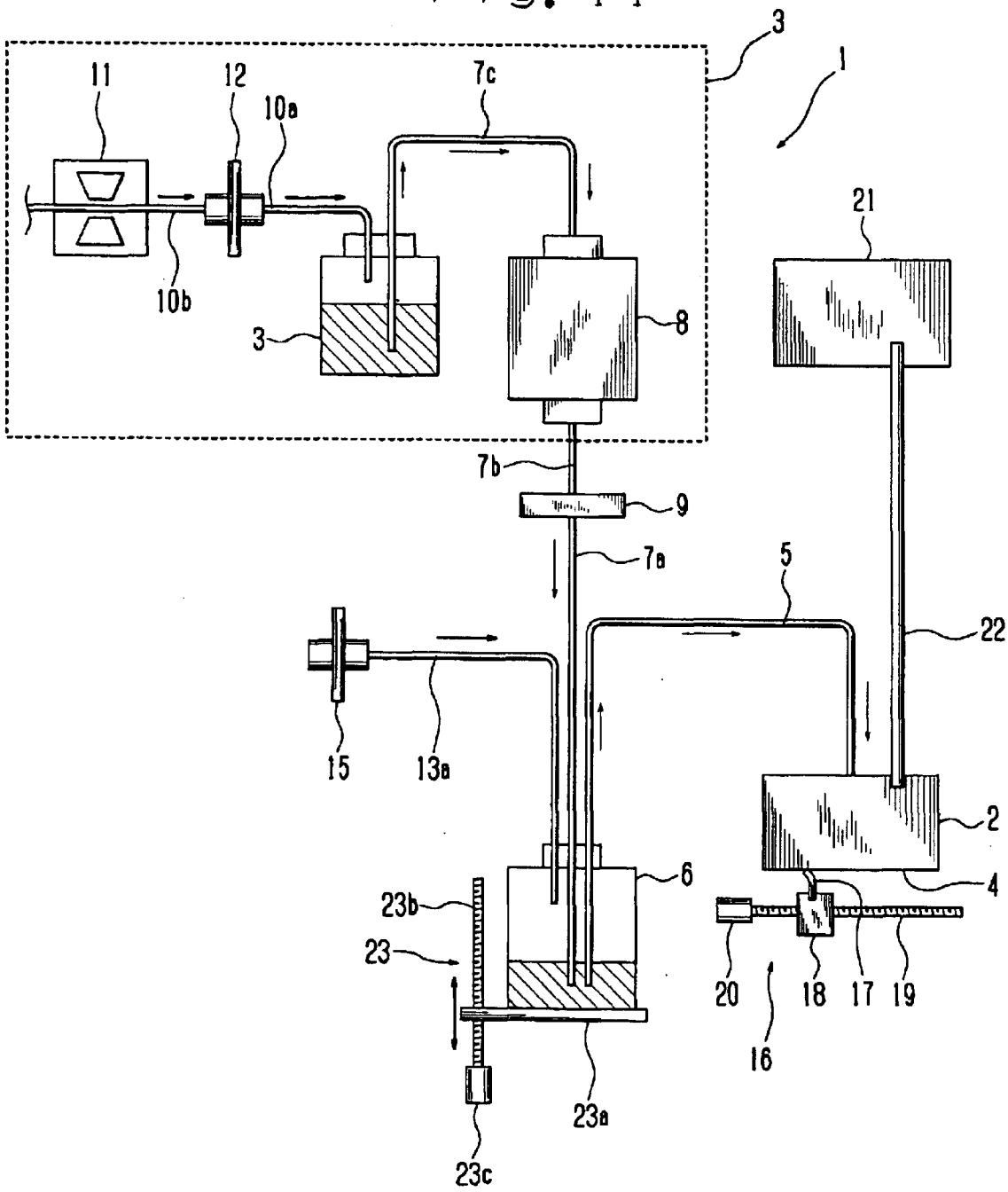
FIG. 11 is a schematic diagram of an ink jet recording apparatus showing another embodiment of the present invention.

FIG. 11 is a schematic diagram of an ink jet recording apparatus 1 illustrative of another embodiment of the present invention. The ink jet recording apparatus 1 shown in FIG. 11 does not include the purge device 14 and the pipe line member 13*b*. Therefore, the pressure control tank 6 is opened into the air through a filter 15.

Further, the ink jet recording apparatus 1 shown in FIG. 11 is provided with an up-and-down motion mechanism used as a displacement mechanism which allows the pressure control tank 6 used as an ink holder to perform up-and-down movements in a vertical direction.

As one example of the up-and-down motion mechanism, an up-and-down motion mechanism 23 is shown in FIG. 11 which comprises a support table 23*a* for supporting the pressure control tank 6, a screw member 23*b* inserted into the support table 23*a*, and a motor 23*c* coupled to the screw member 23*b*. For example, a stepping motor or the like can be used as the motor 23*c*. In the present embodiment, the direction of driving of such a motor 23*c* as to displace the support table 23*a* in an upward direction is taken as a forward direction, whereas the direction of driving of such a motor 23*c* as to displace the support table 23*a* in a downward direction is taken as a reverse direction.

Figure 12:
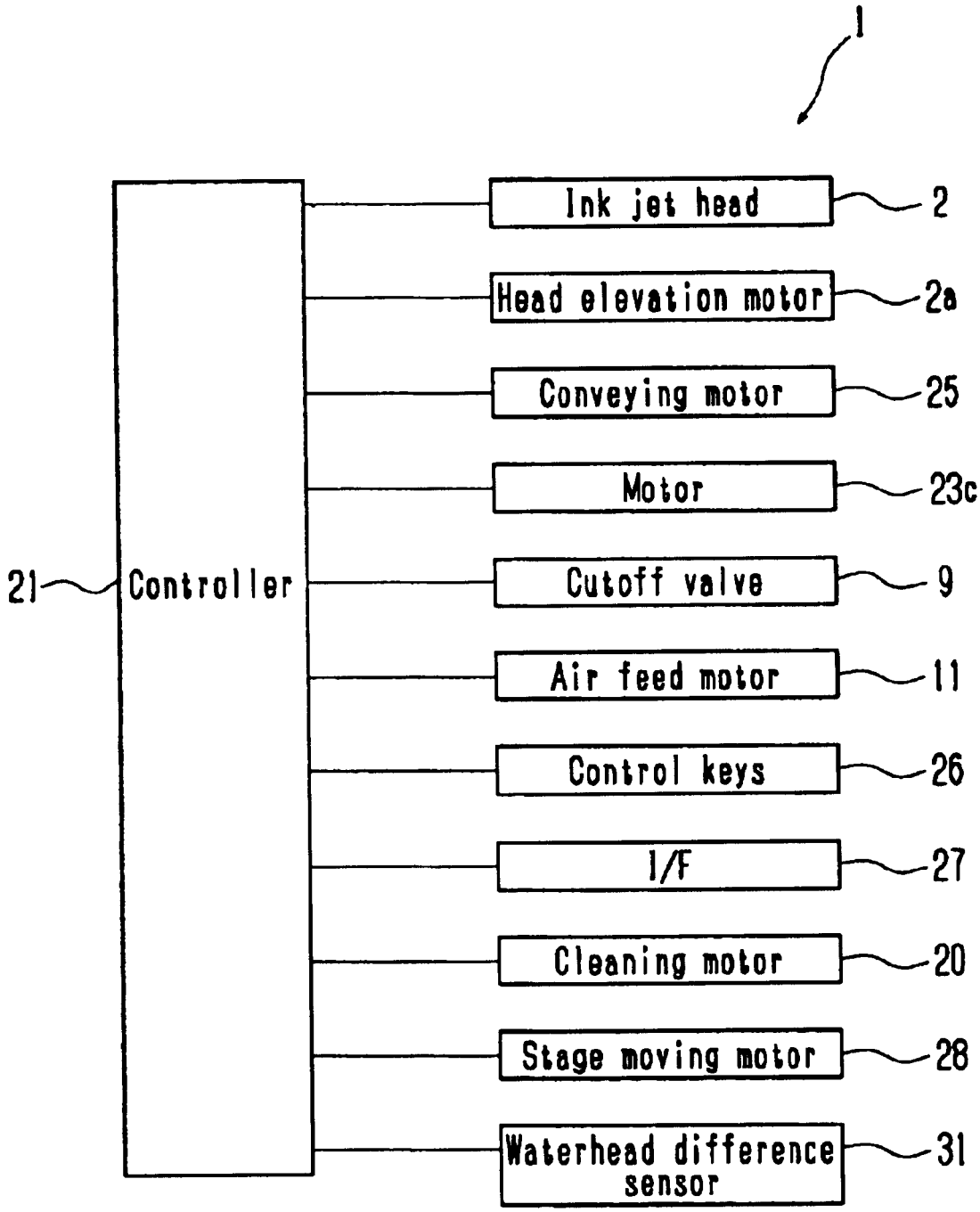
FIG. 12 is a block diagram schematically showing electrical connections of respective portions with which the ink jet recording apparatus showing another embodiment of the present invention is equipped.

Here, FIG. 12 is a block diagram schematically showing electrical connections of respective portions with which the ink jet recording apparatus 1 is equipped. The motor 23*c* is connected to a controller 21 with which the ink jet recording apparatus 1 showing the present embodiment is equipped. Upon execution of a cleaning operation to be described later, the controller 21 drives the motor 23*c* switchably in a reciprocal direction.

Figure 13:
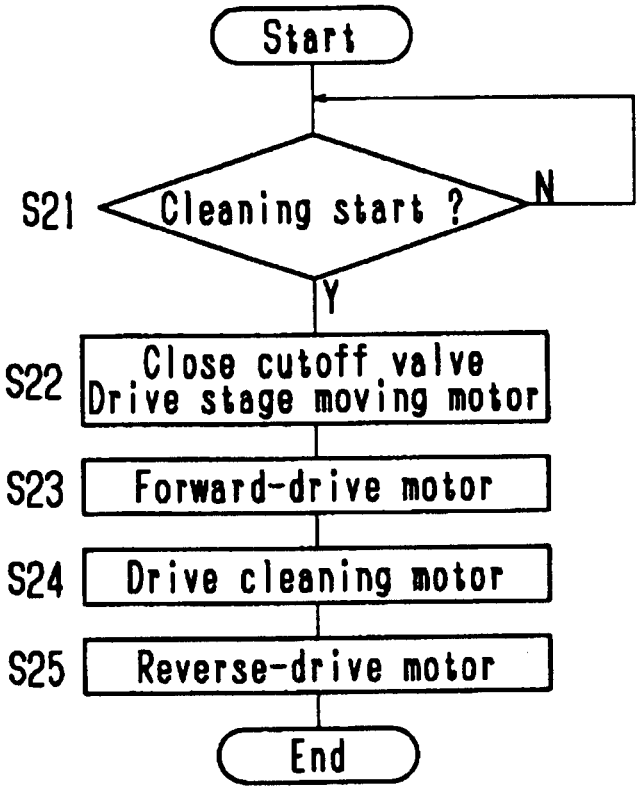
FIG. 13 is a flowchart for schematically describing a nozzle cleaning process executed by a controller with which the ink jet recording apparatus showing another embodiment of the present invention is equipped.

The nozzle cleaning operation of the ink jet recording apparatus 1 shown in FIG. 11 will next be described. FIG. 13 is a flowchart for schematically describing a nozzle cleaning process executed by the controller. The nozzle cleaning process is performed with timing at which the execution of the nozzle cleaning process is declared by key operations of an operator or timing at which the above-described print operation is executed a predetermined number of times.

When it is determined that the execution of the nozzle cleaning operation has been declared (Y in S21) while the declaration of execution of the nozzle cleaning operation is being awaited (N in Step S21), a cutoff valve 9 is positioned to a block position to shut off the supply of ink from an ink tank 24, and a stage moving motor 28 is driven to position a stage 30 to a cleaning position (Step S22).

Then the motor 23*c* is driven in the forward direction (Step S23) to displace the pressure control tank 6 upward along the vertical direction.

Since the pressure control tank 6 and the ink tank 24 are held in a cutoff state, a difference in height occurs between a vapor-liquid interface Y of the pressure control tank 6 and a nozzle position X with the displacement of the pressure control tank 6 upward. In doing so, pressure is applied to each pressure chamber according to the difference in height between the liquid-vapor interface Y of the pressure control tank 6 and the nozzle position X. Here, a mechanism for applying the pressure is realized.

Figure 14:
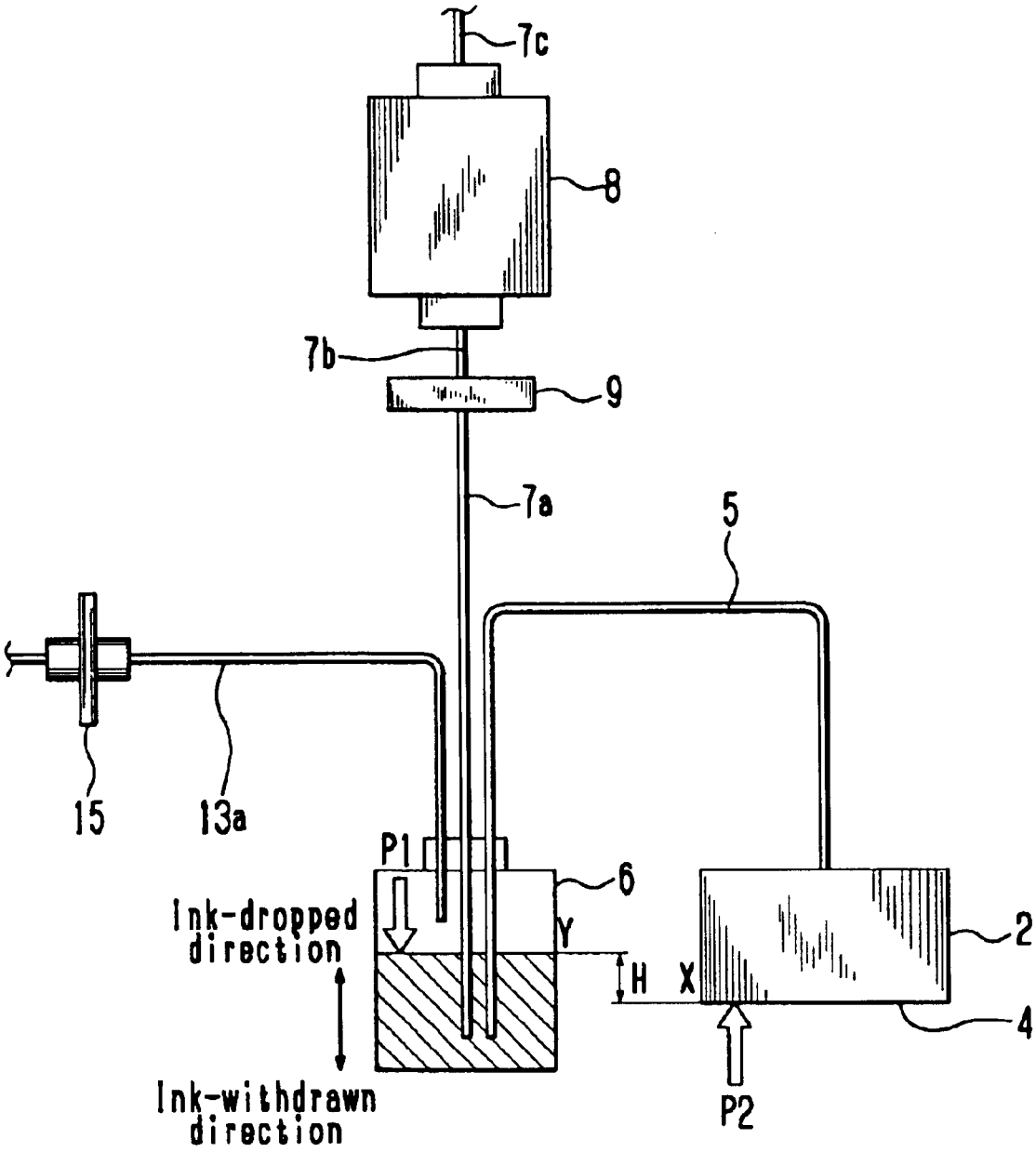
FIG. 14 is an explanatory view showing the relationship between a vapor-liquid interface and a nozzle position at a pressure control tank in the ink jet recording apparatus showing another embodiment of the present invention.

Here, the relationship between the vapor-liquid interface Y of the pressure control tank 6 and the nozzle position X, and the pressure applied to ink at the nozzle position X will be explained with reference to FIG. 14. The pressure control tank 6 is opened into the air through the pipe line member 13*a* and the filter 15, and the nozzles 10 are also opened into the air. Therefore, when the difference in position (height) as viewed in the vertical direction between the vapor-liquid interface Y of the pressure control tank 6 and the nozzle position X is taken as a waterhead difference H, the pressure applied to the ink at the vapor-liquid interface Y of the pressure control tank 6 is taken as P1, and the pressure applied to the ink at the nozzle position X is taken as P2, the difference P in pressure between the vapor-liquid interface Y of the pressure control tank 6 and the nozzle position X is expressed in an equation (2) shown below:

$$\text{pressure difference } P = (\text{specific gravity of ink}) \times (\text{waterhead difference } H) \quad (2)$$

In the present embodiment, the pressure difference P expressed in the equation (2) raises the pressure control tank 6 in such a range that the pressure difference P becomes lower than the pressure PT expressed in the equation (1).

Incidentally, when the waterhead difference H is 0, i.e., the vapor-liquid interface Y of the pressure control tank 6 and the nozzle position X are located at the same height, the pressure difference P between the pressure P1 and the pressure P2 results in 0.

Thus, as shown in FIG. 10A, the ink in each pressure chamber is extruded from the nozzles 10 and capable of maintaining a positive pressure state in which the ink is ejected from the nozzles 10 to the outside of each pressure chamber, by its own surface tension. Here, means for controlling the pressure applied to each pressure chamber is realized.

A cleaning motor 20 in an ink jet head cleaning means 16 is driven in the raised state of the pressure control tank 6 (Step S24) to move the cleaning member along the nozzles 10 in a state in which the cleaning member has been abutted against the nozzle plate 4.

Thus, the ink remaining around the nozzles 10, for example can be swept from the nozzle plate.

Incidentally, the ink jet head cleaning means 16 may be driven while waiting for the elapse of a predetermined time after the pressure control tank 6 has been raised in Step S23. It is thus possible to stabilize an ink level or face F and more effectively remove foreign particles around the nozzles 10.

When the sweeping of the nozzle plate 4 by the ink jet head cleaning means 16 is completed, the motor 23*c* is driven in a reverse direction to de-elevate the support table 23*a* until the vapor-liquid interface Y of the pressure control tank 6 and the nozzle position X become equal to each other.

Namely, according to an ink jet head cleaning means 16 described in a first claim of the present invention, it is equipped with a cleaning member 17 abutted against a nozzle plate 4 formed with a plurality of nozzles 10 respectively communicating with a plurality of pressure chambers for holding ink therein, a mechanism for applying pressure to all the pressure chambers, means for controlling the pressure applied to the pressure chambers by the mechanism for applying the pressure to the ink in each pressure chamber, in such a manner that the ink is brought to a positive pressure state of being ejected from the respective nozzles 10 to the outside of the pressure chamber, and a mechanism for moving the cleaning member 17 along the nozzles 10 under the positive pressure state. Therefore, the ink ejected from the nozzles 10 to the outside of each pressure chamber extrudes foreign particles outside the pressure chamber, and the extruded foreign particles are collected by the cleaning member 17 together with the ink. It is therefore possible to purge the foreign particles contained in the ink and the foreign particles around the nozzles 10 without consuming much ink needlessly and damaging the nozzle plate 4.

According to an ink jet recording apparatus 1 described in a sixth claim of the present invention, which is equipped with such an ink jet head cleaning means 16, satisfactory delivery performance can be exhibited upon printing.

According to the ink jet head cleaning means 16 described in a second claim of the present invention, the mechanism for applying the pressure is a pressure pump provided to a purge device 14 communicating with the respective pressure chambers, and the pressure control means controls the pressure applied to the pressure chambers by the pressure pump. Therefore, the aforementioned effects can be obtained owing to the utilization of the pressure pump included in the purge device 14 without providing a particular mechanism to apply the pressure to all of the pressure chambers and involving an increase in the size of the apparatus.

According to the ink jet recording apparatus 1 described in a seventh claim of the present invention, which is equipped with such an ink jet head cleaning means 16, satisfactory delivery performance can be exhibited upon printing without providing a particular mechanism to apply pressure to all the pressure chambers and involving an increase in the size of the apparatus.

According to the ink jet head cleaning means 16 described in a third claim of the present invention, it includes an ink holder 6 for holding ink supplied to each pressure chamber, and a displacement mechanism 23 for allowing the ink holder 6 to be displaced in the direction vertical to a nozzle position X. The pressure applying mechanism positions a vapor-liquid interface Y at the ink holder 6 to a position higher than the nozzle position X by means of the displacement mechanism 23 to thereby apply the pressure to all the pressure chambers. Therefore, the aforementioned effects can be obtained without providing a particular mechanism to apply the pressure to all the pressure chambers and involving an increase in the size of the apparatus.

According to the ink jet recording apparatus 1 described in an eighth claim of the present invention, which is equipped with such an inject head cleaning means 16, such an ink jet recording apparatus 1 as to make it possible to effectively exhibit satisfactory delivery performance upon printing can be realized without providing a particular mechanism and involving an increase in the size of the apparatus.

According to the ink jet head cleaning means 16 described in a fourth claim of the present invention, the cleaning member is formed of a material having moisture absorbency. It is therefore possible to efficiently recover foreign particles extruded outside each pressure chamber by the ink ejected from the respective nozzles 10 to the outside of the pressure chamber.

According to the ink jet recording apparatus 1 described in a ninth claim of the present invention, which is equipped with such an ink jet head cleaning means 16, satisfactory delivery performance can effectively be exhibited upon printing.

According to the ink jet head cleaning means 16 described in a fifth claim of the present invention, the cleaning member 17 is formed of a material having elasticity. Therefore, damage of the nozzle plate 4 can be suppressed even when the cleaning member 17 is adhered to the nozzle plate 4, and some friction occurs between the cleaning member 17 and the nozzle plate 4 due to its adhesion.

According to the ink jet recording apparatus 1 described in a tenth claim of the present invention, which is equipped with such an ink jet head cleaning means 16, durability of the nozzle plate 4 can be enhanced, and satisfactory delivery performance can be exhibited over a long period upon printing.

Apparently, a large number of modifications and changes in the present invention can be made in light of the above descriptions. Accordingly, it is understood that the present invention can be also implemented within the scope of the appended claims by embodiments different from ones specifically described herein.

What is claimed is:

1. An ink jet head cleaning means, comprising:

a cleaning member abutted against a nozzle plate formed with a plurality of nozzles respectively communicating with a plurality of pressure chambers for holding ink therein;

a mechanism for applying pressure to all of the pressure chambers;

means for controlling the pressure applied to each of the pressure chambers by the mechanism for applying the pressure, such that the ink in each of the pressure chambers is brought to a positive pressure state in which ink is extruded form the respective nozzles such that a meniscus of the ink protrudes from the respective nozzles, and a surface tension of the ink holds the protruding meniscus and prevents the ink from dropping from the respective nozzles; and a mechanism for moving the cleaning member along the nozzles while the ink in the pressure chambers is under the positive pressure state.

2. The ink jet head cleaning means according to claim 1, wherein the mechanism for applying the pressure comprises pressure pump which is provided in a purge device that communicates with the respective pressure chambers, and wherein the pressure control means controls the pressure applied to the pressure chambers by the pressure pump.

3. The ink jet head cleaning means according to claim 1, further including:

an ink holder for holding ink supplied to the pressure chambers; and a displacement mechanism for vertically displacing the ink holder with respect to a nozzle position, wherein the mechanism for applying the pressure positions a vapor-liquid interface at the ink holder to at a position higher than the nozzle position by means of the displacement mechanism to thereby apply the pressure to all the pressure chambers.

4. The ink jet head cleaning mechanism according to claim 1, wherein the cleaning member is formed of a material having moisture absorbency.

5. The ink jet head cleaning mechanism according to claim 1, wherein the cleaning member is formed of a material having elasticity.

6. An ink jet recording apparatus, comprising:

an ink jet head having a plurality of pressure chambers for holding ink therein, and a nozzle plate formed with a plurality of nozzles respectively communicating with the pressure chambers;

a cleaning member abutted against the nozzle plate;

a mechanism for applying pressure to all of the pressure chambers;

means for controlling the pressure applied to each of the pressure chambers by the mechanism for applying the pressure, in such a manner that the ink in each of the pressure chambers is brought to a positive pressure state in which ink is extruded from the respective nozzles, such that a menicus of the ink protrudes from the respective nozzles, and a surface tension of the ink holds the protruding meniscus and prevents the ink from dropping from the respective nozzles; and a mechanism for moving the cleaning member along the nozzles while the ink in the pressure chambers is under the positive pressure state.

7. The ink jet recording apparatus according to claim 6, wherein the mechanism for applying the pressure comprises a pressure pump which is provided in a purge device and wherein the pressure pressure control means controls the pressure applied to the pressure chambers by the pressure pump.

8. The ink jet recording apparatus according to claim 6, further comprising:

an ink holder for holding ink supplied to the pressure chambers; and a displacement mechanism for vertically displacing the ink holder with respect to a nozzle position, wherein the mechanism for applying the pressure positions a vapor-liquid interface at the ink holder at a position higher than the nozzle position by means of the displacement mechanism to apply the pressure to all of the pressure chambers.

9. The ink jet recording apparatus according to claim 6, wherein the cleaning member is formed of a material having moisture absorbency.

10. The jet recording apparatus according to claim 6, wherein the cleaning member is formed of a material having elasticity.

11. A method for cleaning an ink jet head comprising a nozzle plate including a plurality of nozzles which respectively communicate with a plurality of pressure chambers for holding ink, said method comprising:

applying pressure to all of the pressure chambers such that the ink in each of the pressure chambers is brought to a positive pressure state in which ink is extruded from the respective nozzles such that a meniscus of the ink protrudes from the respective nozzles, and a surface tension of the ink holds the protruding meniscus and prevents the ink from dropping from the respective nozzles; and moving a cleaning member along the nozzles while the ink in the pressure chambers is under the positive pressure state.

12. The method according to claim 11, wherein the pressure is applied using a pressure pump which is provided in a purge device that communicates with the respective pressure chambers.

13. The method according to claim 11, wherein an ink holder holds ink supplied to the pressure chambers, and the pressure is applied by displacing the ink holder to position a vapor-liquid interface in the ink holder at a position higher than a nozzle position of the ink jet head.

14. The method according to claim 11, wherein the cleaning member is formed of a material having moisture absorbency.

15. The method according to claim 11, wherein the cleaning member is formed of a material having elasticity.

* * * * *